US005639036A

United States Patent [19]

Flamm

[11] Patent Number: 5,639,036

[45] Date of Patent: Jun. 17, 1997

[54] APPARATUS FOR CONTROLLING A YARN PACKAGE CREEL OF A TEXTILE MACHINE

[75] Inventor: Franz-Josef Flamm, Stolberg, Germany

[73] Assignee: W. Schlafhorst AG & Co., Moenchengladbach, Germany

[21] Appl. No.: 684,546

[22] Filed: Jul. 19, 1996

[30] Foreign Application Priority Data

Jul. 26, 1995 [DE] Germany ..... 195 27 214.5

[51] Int. Cl.[6] ..... B65H 54/00; B65H 18/14; F16H 27/02

[52] U.S. Cl. ..... 242/18 DD; 74/89.2; 242/541.5

[58] Field of Search ..... 242/18 DD, 18 R, 242/541.5; 74/89.2

[56] References Cited

U.S. PATENT DOCUMENTS

| | | | |
|---|---|---|---|
| 3,675,862 | 7/1972 | Tsukuma et al. | 242/18 R |
| 3,777,995 | 12/1973 | Funaioli et al. | 242/18 DD |
| 3,905,560 | 9/1975 | Trifunovic et al. | 242/18 DD |
| 4,054,250 | 10/1977 | Herubel | 242/18 DD |
| 4,085,900 | 4/1978 | Marcio | 242/18 DD |
| 4,451,006 | 5/1984 | Decuq et al. | 242/18 DD |
| 4,654,736 | 3/1987 | Kaczeus et al. | 74/89.2 X |
| 5,207,114 | 5/1993 | Salisbury, Jr. et al. | 74/89.2 X |

FOREIGN PATENT DOCUMENTS

| | | | |
|---|---|---|---|
| 600008 | 6/1960 | Canada | 242/18 DD |
| 39 27 142 | 2/1991 | Germany . | |
| 55-35775A | 3/1980 | Japan . | |

*Primary Examiner*—Micheal Mansen
*Attorney, Agent, or Firm*—Shefte, Pinckney & Sawyer

[57] ABSTRACT

In a textile machine wherein a creel is pivotably supported on a pivot shaft, pivoting movements of the creel and its shaft are controlled via an electrical motor generating torque and a belt transmission unit connecting the motor to the pivot shaft. The belt transmission unit includes at least one belt wound about the drive shaft of the motor and secured to the drive shaft and to two securing points of a transmission lever fixed to the pivot shaft.

5 Claims, 1 Drawing Sheet

APPARATUS FOR CONTROLLING A YARN PACKAGE CREEL OF A TEXTILE MACHINE

FIELD OF THE INVENTION

The present invention pertains to an apparatus for controlling a creel for supporting a yarn package in a textile machine, wherein the creel is pivotably supported by means of a pivot shaft connected to an electrical means for generating torque via a drive shaft extending parallel to the pivot shaft of the creel and connected thereto by means of a transmission device.

BACKGROUND OF THE INVENTION

A representative example of an apparatus of the above-described type is disclosed in German Patent Publication DE 39 27 142 A1, the intent of which is for the contact pressure between a bobbin held by the creel and a contact roller frictionally driving the bobbin to be controlled so that the bobbin can be lifted from the driving roller, as needed, in order to obtain a contact pressure that is adapted to the bobbin makeup and to effect a damping of vibration of the creel. In the known design, a toothed belt drive acts as the transmission device and is joined to the creel via a rod linkage. Practical experiments with this kind of device and with toothed-wheel gears have not led to a version suitable in practice, especially if functions such as the detection of the bobbin diameter and/or damping of bobbin vibration are to be achieved. For those purposes and especially for vibration damping, reactions by the torque generating means were not sufficiently fast and exact to provide commercially acceptable results.

OBJECT AND SUMMARY OF THE INVENTION

It is accordingly an object of the present invention to provide an improved creel control apparatus of the basic type described above such that an exact, fast reaction of the torque generating means is transmitted reliably to the creel and the bobbin.

This object is attained by providing a belt transmission unit which includes at least one belt wound about the drive shaft of the torque generating means, which belt is secured to the drive shaft and to two securing points of a transmission lever fixed to the pivot shaft to pivot integrally therewith without relative rotation. The securing points are disposed at an angular spacing relative to the axis of the pivot shaft of the creel.

The invention is based on the recognition that it is necessary to provide a transmission unit that is essentially free of play and free of any hysteresis effect and moreover can be allowed to have only natural frequencies that are markedly above the frequencies of vibration of the creel. These conditions are met by a belt transmission unit of the basic type described above, since it is practically play-free and hysteresis-free. Moreover, the natural frequency can be varied in the direction of higher natural frequencies by means of the design of the belt or belts, so that resonance can be avoided.

According to one feature of the invention, the belt or belts are wound helically about the drive shaft with individual turns of the belt or belts located side by side on the drive shaft. This assures that during the rotation of the drive shaft, no differences in diameter and hence no different travel distances will result during the winding up and unwinding of the belt or belts.

According to another feature of the invention, the transmission lever has a cylindrical end portion that is concentric to the pivot shaft, with a radius equal to the distance between the circumference of the drive shaft and the pivot shaft, minus the thickness of the belt or belts. This assures that the belt or belts are guided and supported over their entire length between the securing points and the drive shaft and hence do not undergo any vibration in their crosswise direction.

A further feature of the invention provides that the belt or belts are wound onto the drive shaft with an initial tension. As a result, virtually all play can be evened out so that the belt transmission unit works largely without play or hysteresis, and, particularly when the creel is damped by the torque-generating means, the particular torque required can be transmitted to the creel quickly and exactly.

Further characteristics and advantages of the invention will become apparent from the ensuing description of the exemplary embodiment shown in the drawings.

DESCRIPTION OF THE PREFERRED EMBODIMENTS

Figure 1:
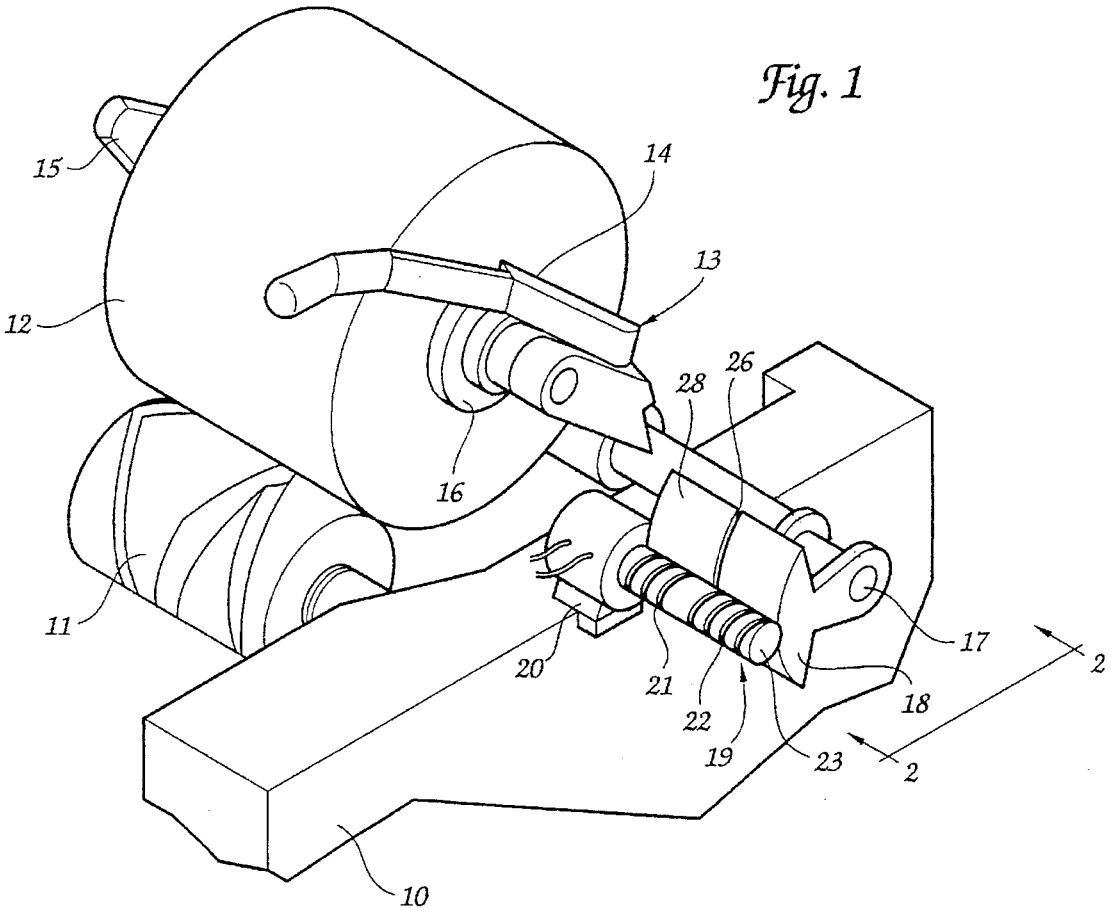
FIG. 1 is a fragmentary perspective view of a yarn winding station in a textile winding machine equipped with a creel and a control apparatus according to the present invention.

Referring now to the accompanying drawings and initially to FIG. 1, a single winding station of a bobbin winding machine is shown having a machine housing 10 which supports a yarn guide drum 11 driven by an electric drive motor (not shown). A cross-wound bobbin 12 is held by a creel 13 in peripheral contact with the yarn guide drum 11 to be frictionally driven by the drum 11. The creel 13 has two spaced bobbin support arms 14, 15 each of which are provided with rotatable bobbin engagement bearings 16 between which a bobbin tube (not shown) is held securely in place to be rotationally driven by the drum 11 for winding of yarn onto the tube to form the cross-wound bobbin 12. In a known manner not shown in detail in the drawings, the bobbin arm 14 can be pivoted together with its bobbin engagement bearing 16 axially away from the bobbin 12, so that a full bobbin 12 can be removed from the creel 13 and an empty tube can be inserted.

The creel 13 is supported pivotably by the machine housing 10 on a rotatable pivot shaft 17 disposed parallel to the axis of the yarn guide drum 11. The creel 13 is fixed to the pivot shaft 17 against rotation relative thereto to pivot integrally therewith and, similarly, a transmission lever 18 is fixedly mounted on the pivot shaft 17 to pivot integrally therewith. The transmission lever 18 is connected by a belt transmission unit 19 to a torque generating device 20, preferably for example an electrical motor suitable for stationary operation.

The electric motor 20 is provided with an associated controller that controls the contact pressure with which the bobbin 12 rests against the yarn guide drum 11 and likewise, in certain cases, controls lifting of the bobbin 12 away from the yarn guide drum 11. For instance, the electric motor 20 may be of the type, and arranged in the manner, disclosed in German Patent Publication DE 39 27 142 A1, the specification of which is incorporated herein by reference. German Patent Publication DE 39 27 142 A1 describes in detail the functions that are obtainable by controlling the contact pressure between the bobbin 12 and the yarn guide drum, including particularly the prevention of ribboning in bobbin winding by generating a defined slip between the bobbin 12 and the yarn guide drum 11, measuring yarn winding density by measuring the current consumption of the motor on lifting the bobbin 12, and damping vibrations of the creel 13 as well as compensating for the weight of the bobbin 12 and the creel 13.

The belt transmission unit 19 functions without play and without hysteresis to a practical extent. In the exemplary embodiment, the belt transmission unit 19 includes two belts 21,22, which are wound helically around the drive shaft 23 of the electric motor 20 in opposition to one another such that upon a rotation of the drive shaft 23, one belt winds around the drive shaft 23, while the other belt is unwound from the drive shaft 23. The belts 21,22 should have high tensile strength yet nevertheless should be flexible. Suitable materials for the belts 21,22 are both metal and plastic, an example being belts of aramide fibers or other fiber-reinforced plastic. The belts 21,22 are preferably steel belts in the illustrated embodiment.

Figure 2:
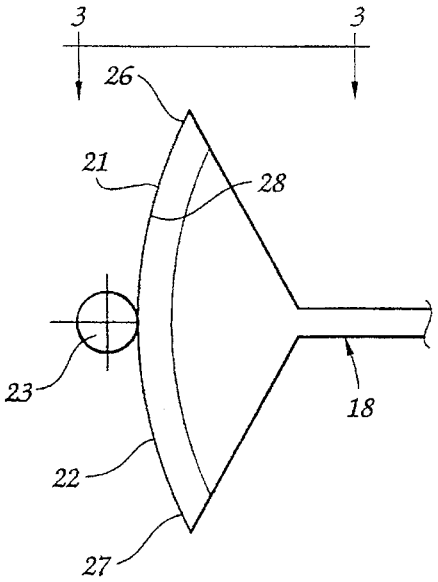
FIG. 2 is a partial end elevational view of FIG. 1 taken in the direction of the arrow II in FIG. 1 on a larger detailed scale.
Figure 3:
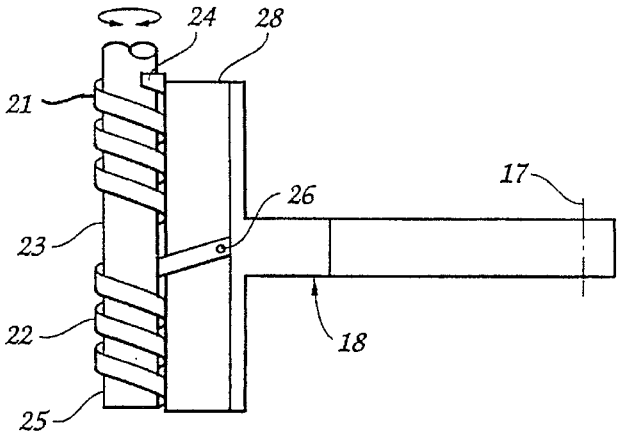
FIG. 3 is a top plan view of FIG. 2 taken in the direction of the arrow III in FIG. 2.

As best seen in FIGS. 2 and 3, the belts 21,22 are secured at their respective ends to the drive shaft 23 by securing means 24,25 and are wound up helically onto the drive shaft 23 with identical pitch. Midway along the length of the drive shaft 23, the belts 21,22 are secured to the transmission lever 18 at spaced securing points 26,27 located at an angular spacing relative to the rotational axis of the pivot shaft 17 of the creel about which the transmission lever 18 also pivots. The winding and unwinding motions of the belts 21,22 resulting from a rotation of the drive shaft 23 are thus transmitted into a pivoting motion of the transmission lever 18 and hence effect corresponding pivoting of the creel 13. The transmission lever 18 is provided with a cylindrical end portion 28 concentric to the pivot shaft 17 with a radius which is equivalent to the spacing between the axis of the pivot shaft 17 and the adjacent facing circumferential surface of the parallel drive shaft 23 less the thickness of the belts 21,22. The belts 21,22 are mounted with a defined prestressing, and are thus guided and supported by means of the cylindrical end portion 28 even along their extents that are not wound up onto the drive shaft 23.

The belt transmission unit 19 functions without play and without hysteresis, so that every reaction of the electrical motor 20 (or other torque generating means) is transmitted quickly and exactly to the creel 13, which is especially necessary in damping of the creel 13. Moreover, the belt transmission unit has a natural frequency that is markedly higher than the natural frequency of the creel 13. In particular, the natural frequency of the belt transmission unit can be varied by the design of the belts 21,22, for instance by the choice of the cross-sectional area of the belts 21,22, the initial tension of the belts 21,22, the choice of material for the belts 21,22, and so forth. The step-up ratio of the belt transmission unit 19, which is on the order of magnitude of 10:30 depending on the design of the electric motor 20, is determined from the diameter of the drive shaft 23 and from the radial spacing of the securing points 26, 27 of the transmission lever 18 from the pivot shaft 17.

A belt transmission unit operating in accordance with the same principle as the unit described above and depicted in conjunction with FIGS. 1–3 can also be achieved with only a single belt. In such case, the opposite ends of the single belt are secured to securing points 26,27 on the transmission lever 18, while a location midway along the length of the belt is then secured to the drive shaft 23, for instance being fastened in place by a clamping element.

It will therefore be readily understood by those persons skilled in the art that the present invention is susceptible of a broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. In a textile machine having a creel fixed for pivotable movement on a pivot shaft, an apparatus for controlling pivoting movements of the creel comprising an electrical means for generating torque, the torque generating means including a drive shaft extending parallel to the pivot shaft of the creel, a transmission unit fixed to the pivot shaft to pivot integrally therewith, and a belt transmission unit connecting the torque generating means to the pivot shaft, the belt transmission unit comprising at least one belt wound about the drive shaft and secured to the drive shaft and to two securing points on the transmission unit at an angular spacing relative to the axis of the pivot shaft.

2. The apparatus of claim 1, wherein the at least one belt is wound helically about the drive shaft in individual turns of the belt located side by side one another along the drive shaft.

3. The apparatus of claim 1, wherein the transmission lever has a cylindrical end portion that is concentric to the pivot shaft and is of a radius equal to the distance between the outer surface of the drive shaft and the pivot shaft less the thickness of the at least one belt.

4. The apparatus of claim 1, wherein the at least one belt is wound onto the drive shaft with an initial tension.

5. The apparatus of claim 1, wherein two belts are wound around the drive shaft, one end of each belt being secured to the drive shaft and the opposite end of each belt being secured to a respective one of the securing points on the transmission lever.

* * * * *